US006474044B1

(12) United States Patent
Simionato

(10) Patent No.: US 6,474,044 B1
(45) Date of Patent: Nov. 5, 2002

(54) VERTICAL PACKAGING MACHINE WITH DEVICE FOR THE APPLICATION OF A SYSTEM OF OPENING AND CLOSING THE PACKAGING

(75) Inventor: Paolo Simionato, Padua (IT)

(73) Assignee: Simionato S.p.A., Padua (IT)

( * ) Notice: Subject to any disclaimer, the term of this patent is extended or adjusted under 35 U.S.C. 154(b) by 176 days.

(21) Appl. No.: 09/618,758

(22) Filed: Jul. 18, 2000

(30) Foreign Application Priority Data

Jul. 22, 1999 (IT) ..... MI99A1619

(51) Int. Cl.[7] ..... B65B 61/18
(52) U.S. Cl. ..... 53/412; 53/133.4; 53/139.2
(58) Field of Search ..... 53/412, 416, 133.4, 53/139.2; 156/66; 493/213, 214, 927; 383/63

(56) References Cited

U.S. PATENT DOCUMENTS 4,548,018 A * 10/1985 Wojnicki ..... 53/135.3
4,909,017 A * 3/1990 McMahon et al. ..... 156/66
6,017,412 A * 1/2000 Van Erden et al. ..... 156/290
6,032,437 A * 3/2000 Bois ..... 493/213
6,044,621 A * 4/2000 Malin et al. ..... 493/214
6,219,993 B1 * 4/2001 Linkiewicz ..... 493/213

FOREIGN PATENT DOCUMENTS

FR 2770487 A1 5/1999

* cited by examiner

*Primary Examiner*—John Sipos
*Assistant Examiner*—Hemant M. Desai
(74) *Attorney, Agent, or Firm*—Young & Thompson

(57) ABSTRACT

An assembly of a vertical packaging machine and a device for the application of a system of opening and closing the packaging, wherein the device for the application of a system of opening and closing the packaging, handled by a programmable controller, comprises, upstream of the forming tube, a carriage slidingly supported by the framework of the machine in the direction of forward movement of the wrapping to be formed; a first welding unit supported by said carriage for a first phase of welding of the zip; means supported by said carriage for positioning the zip on the wrapping in the position of a first welding of the zip; and, downstream of the forming tube and of the first welding unit, a second welding unit for a phase of final welding of the zip to the packaging.

33 Claims, 4 Drawing Sheets

VERTICAL PACKAGING MACHINE WITH DEVICE FOR THE APPLICATION OF A SYSTEM OF OPENING AND CLOSING THE PACKAGING

FIELD OF THE INVENTION

The present invention relates to a device for the application of a system of opening and closing a packaging, denoted in the field by the name of "zip", which can be installed on a vertical packaging machine.

BACKGROUND OF THE INVENTION

For the application of the zip, which requires feeding in a transverse direction in relation to the direction of feeding of the wrapping for packaging, the current most widespread techniques involve the use of grippers or devices for the creation of the vacuum, designed to grip the zip and to transport it into the correct welding position.

Welding of the zip to the wrapping is divided into a first phase upstream of the forming tube which only involves the male element of the zip and a successive phase downstream of the forming tube wherein the female element of the zip is welded to the wrapping.

Traditional devices for the application of the zip are found however to be slow and inaccurate.

The speed of application of the system of opening and closing onto the wrapping for packaging is an important factor in determining the productivity of the plant and hence the cost of the finished product.

The precision in determining the point of the wrapping whereto the system of opening and closing is to be applied also avoids considerable waste of material. In a process of mass-packaging even small errors of positioning of the zip on one packaging and on the successive one can combine and become no longer negligible, creating packaging with a length substantially different from that set and which therefore should be eliminated.

For correct welding of the zip it is also necessary for the zip band to be welded to be perfectly aligned with the welding plate both in the first and in the successive phase of welding. Thus to avoid having to define at welding the relative position between welding machine and zip within extremely narrow tolerances, there is a tendency nowadays to use a zip with oversized width, so as to create always an area of overlap between zip and welding machine. Naturally this causes a further waste of materials, specifically materials used for manufacturing the zip.

SUMMARY OF THE INVENTION

The main object of the present invention is in fact that of overcoming the disadvantages suffered in the known art, and in particular of providing on a vertical packaging machine a device for the application of a highly productive and precise system of opening and closing the packaging, so as to limit or eliminate completely any possible waste of materials.

Another object of the present invention is that of providing a device for the application of a simple and inexpensive system of opening and closing. Yet another object of the present invention is that of providing a perfected method for application of the zip to the wrapping.

These objects of the present invention are achieved by a device in accordance with the independent claim included hereinbelow.

The invention provides an assembly of a vertical packaging machine and a device for the application of a system of opening and closing the packaging or zip formed by two superimposed elements which can be removably engaged, wherein the vertical packaging machine comprises a framework supporting in succession a feeder of the wrapping for packaging, a vertical forming tube and a welding unit for welding the transverse edges of the formed wrapping, and wherein the device for application of the system of opening and closing, handled by a programmable controller, comprises: upstream of the forming tube, a carriage slidingly supported by the framework of the machine in the direction of forward movement of the wrapping to be formed; a first welding unit supported by said carriage for a first phase of welding of the zip; means supported by said carriage for positioning the zip on the wrapping in the position of the first weld of the zip; and, downstream of the forming tube and of the first welding unit, a second welding unit for a final phase of welding of the zip to the packaging.

In accordance with a preferred method of application of the zip, the front edge of the male element of the zip is welded to the wrapping by the first welding unit, while the remaining edges of the zip are only welded subsequently by the second welding unit.

Advantageously the carriage handled by the programmable controller can slide in relation to the wrapping so as to seek on the wrapping the set position of welding of the zip and accurately position the first welding unit there. In order to increase the production rate it is possible to place the carriage on the framework of the machine in a reference position close to the welding position provided, in such a way that seeking the position of welding on the wrapping only requires a short stroke and hence a brief time of movement for the carriage.

Advantageously means are also introduced for aligning the zip with the welding plate of the second welding unit and proceeding with its correct final welding.

BRIEF DESCRIPTION OF THE DRAWINGS

These and other advantages will be made clearer on reading the following description of a preferred embodiment of the present invention, which refers to the accompanying drawings in which.

DESCRIPTION OF THE PREFERRED EMBODIMENT

Figure 1:
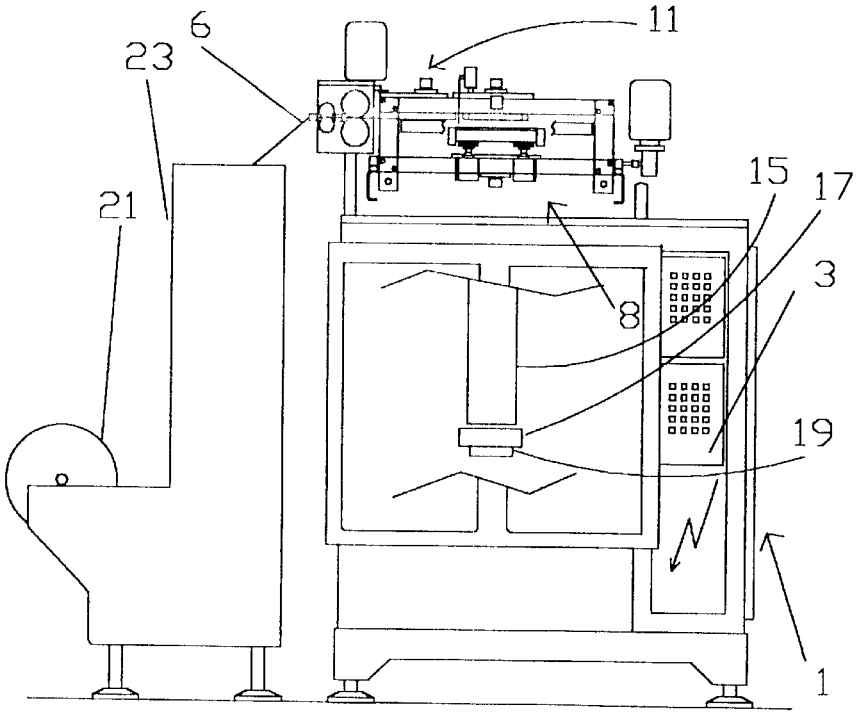
FIG. 1 shows a partially open front schematic view of a vertical packaging machine with device for the application of a system of opening and closing a packaging according to the present preferred embodiment.
Figure 2:
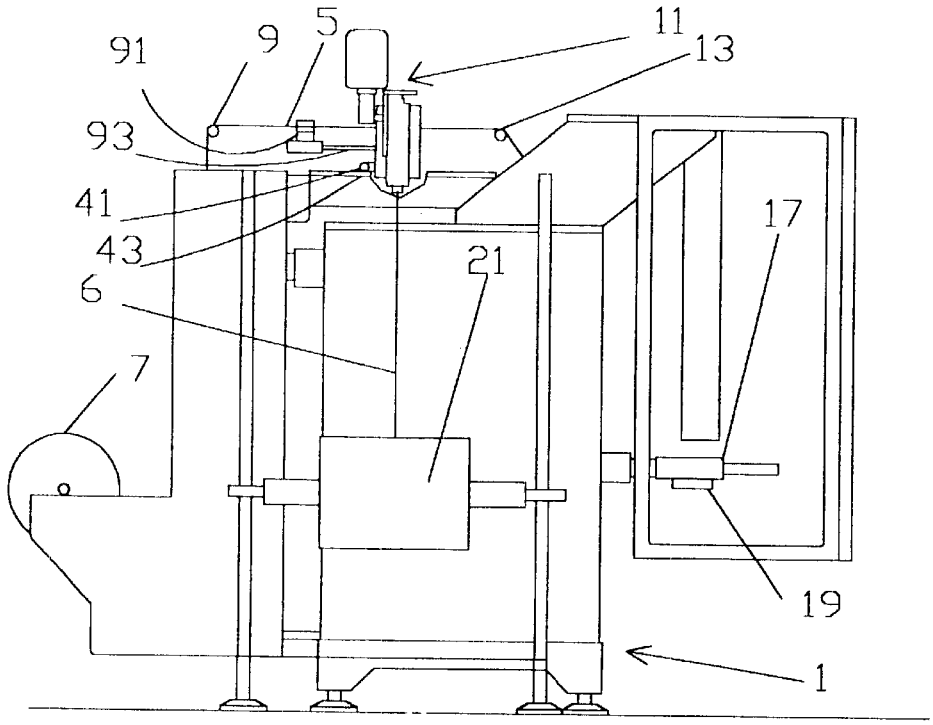
FIG. 2 shows a side schematic view of the machine of FIG. 1.

In FIGS. 1 and 2 the vertical packaging machine with the device for application of the zip is held by a support framework 1 and is handled by a programmable controller via a dialogue interface with push-button panel 3.

The assembly formed by the machine for packaging a wrapping 5 and the device for application of a zip 6 to the wrapping 5 comprises, in the direction of forward movement of the wrapping 5, a feeder of the wrapping 5 formed by a reel 7, with horizontal axis, wherefrom the wrapping 5 is unwound, a roller 9 for feeding the wrapping 5, fixed transversely to the frame 1, a carriage 11 supported by the frame 1 of the machine in such a way as to slide over the wrapping 5 in the direction of forward movement of the wrapping 5 and holding a first unit 8 for welding the zip 6, a drive roller 13 which sends the wrapping 5 towards a forming tube 15 to create the required shape of the wrapping, a welding unit 17 for welding the transverse edges of the formed wrapping and a second unit 19 for the final welding of the zip 6.

The zip 6 is fed over the wrapping 5 in a transverse direction to the direction of forward movement of the wrapping 5 by a reel 21 of the zip 6 with horizontal axis, supported by a relative framework 23.

Figure 3:
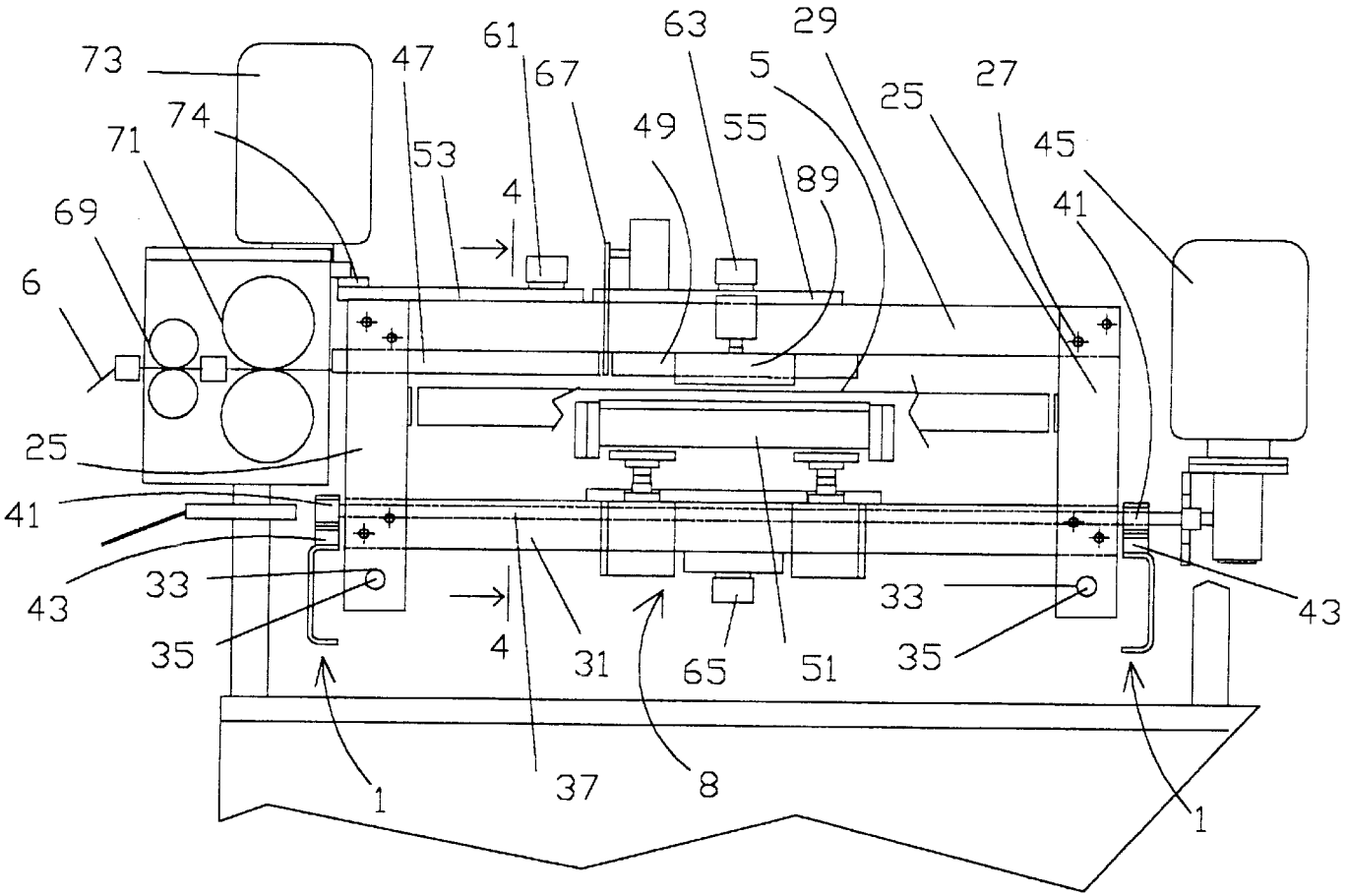
FIG. 3 shows an enlarged front view of the part of the device for application of the zip of FIG. 1 supported by the carriage.

In FIG. 3 it is illustrated how the carriage 11 is supported on the frame 1. The carriage 11 is thus formed by a body which frontally has a substantially rectangular profile formed by two uprights 24, 25 attached by screws 27 to an upper crosspiece 29 and a lower crosspiece 31. The lower end portion of the uprights 25, 25 has a longitudinal hole 33, 33 wherein a fixed linear guide 35 is inserted and arranged longitudinally on the framework of the machine 1, in such a way that the carriage 11 is guided via the hole 33, 33 to slide in a longitudinal direction on the fixed guide 35, 35. The carriage 11 is moved by means of a rod 37 transversely restrained to the carriage 11 so as to remain freely rotating on its own axis, which rod 37 has the opposite ends fitted with pinions 41, 41 in line with the same rod 37, each one meshing with a corresponding rack 43, 43 longitudinally attached to the framework of the machine 1. The right-hand pinion 41 is finally driven by a dedicated gear motor 45 integral with the carriage 11.

To position a preset length of zip 6 on the wrapping 5 in the correct position for the first weld, that is to say in a position vertically aligned with the transverse welding plate 51 of the first welding unit 8, a first block 47 for guiding the zip 6 is provided on the carriage 11 on the side of feeding of the zip 6, extending transversely and towards the interior of the carriage 11 itself, aligned with a second block 49 for supporting the zip 6, also extending transversely and vertically opposite the welding plate 51 of the first welding unit 8.

Naturally the wrapping 5 remains positioned in a plane between the lower surface of the block 49 and the upper surface of the plate 51. The first guide block 47 and the second zip support block 49 are connected to a corresponding mobile guide 53 and 55 supported by the crosspiece 29 of the carriage 11.

Figure 4:
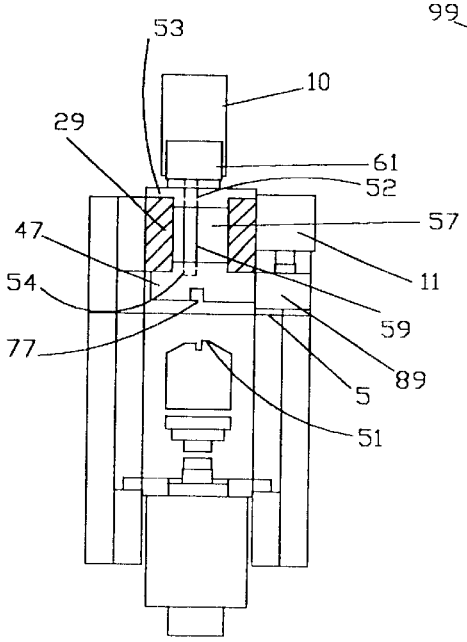
FIG. 4 shows an enlarged side view of the device of the present embodiment partially sectioned along line 4—4 of FIG. 3.

As is also clear in FIG. 4, the blocks 47 and 49 and the respective mobile guides 53 and 55 are T-shaped and the upper crosspiece 29 is traversed by an axially extending vertical opening 57 which creates on the upper base of the crosspiece 29 a fixed guide for the mobile guides 53 and 55 and on the lower base of the crosspiece 29 a fixed guide for the blocks 47 and 49.

The mobile guide 53 has a vertical threaded through hole 52 vertically aligned with a vertical threaded blind hole 54 provided on the upper surface of the corresponding first block 47, in such a way that it is possible to insert an appropriate threaded screw 59 in the hole of the mobile guide 53 and, through the cavity 57, in the hole of the block 47. The screw 59 thus allows the mobile guide 53, supported by the crosspiece 29 of the carriage 11, to support in turn the block 47. The screw 59 can also be actuated manually by means of a knob 61, in such a way as to be loosened to make the block 47 translate and to adjust its position on the fixed guide 29 and locked again to clamp the block 47 in the adjusted position.

The structure of the block 49-mobile guide 55 assembly and the relative mechanism of adjustment of the position on the guide 29 by means of a knob 63 reflect what is described for the block 47-mobile guide 53 assembly and will not be dealt with further.

Also for adjustment of the position of the first welding unit 8 on the lower crosspiece 31, which always has to be vertically opposite the block 49, a system is used which can be actuated by the knob 65 and is similar to that described for the first 47 and second block 49.

For feeding the zip 6 on the wrapping 5, a coder 69 for measuring the length of the zip 6 to be sent onto the wrapping 5 and a pair of rollers 71 for driving the measured zip moved by a dedicated gear motor 73 are provided in succession, in the direction of feeding of the zip. The assembly formed by coder 69, drive rollers 71 and gear motor 73 is supported, cantilevered and by means of a support plaque 74, by the mobile guide 53 of the guide block 47.

In the lower base of the guide blocks 47 and 49 (only block 47 is illustrated in FIG. 4) respective axial housings 75 are formed for the zip 6, aligned one with the other. A blade 77 extends horizontally from the whole lower rear edge of the housing 75 up to the midpoint of the housing 75, inserted between the rear edges 79 and 81 of the male and respectively female elements of the zip 6, which serves both as a support and as guide for the zip 6. The core 83 of the zip is contained in the housing 75 while the front edge 87 rests outside of the housing 75 on the lower wall of the blocks 47 and 49.

Between the outlet end of the guide block 47 and the inlet end of the zip support block 49 there is the minimum space required for inserting a part for cutting the zip. The cutting part, supported by the mobile guide 55, is in the form of a scythe 67 rotating along an axis oriented in a direction transverse to the carriage 11. This cutting system reduces wear of the tool compared to the knives traditionally used, while the adjacent positioning between the outlet end of the guide block 47 and the inlet end of the zip support block 49 prevents the zip from withdrawing from the blade 77.

In front of the zip support block 49 and above the wrapping 5 there is a buffer 89 supported by the mobile guide 55 and which can be actuated vertically on the wrapping 5 to remove the zip 6 from the housing 75 of the zip support block 49 after first welding of the zip in such a way that the wrapping 5 with the zip 6 attached can continue its travel without obstacles.

The device for application of the zip also allows the position of the successive points of the wrapping whereto a corresponding zip is to be attached to be adjusted. For this purpose, on the wrapping, which has a succession of equidistant notches with a pitch defining the length of each packaging, a notch reading photoelectric cell 91 is positioned and attached to the carriage 11 at an adjustable distance from the first welding unit 8 by means of an extensible arm 93 shown in FIG. 2.

The carriage 11 is capable of sliding on the wrapping 5, starting from a predeterminable reference position on the framework of the machine 1, until the point of the wrapping chosen for first welding of the zip 6 is reached. This point is determined by the length of the arm 93, given that it corresponds to the point of the wrapping whereon the welding plate 51 is located when the photoelectric cell 91 reads the notch, as will also be seen hereinunder.

In order to stop the carriage 11 in the reference position a position sensor (not shown) is provided, attached to the framework of the machine 1 at the selected reference position. The reference position of the carriage 11 is indicated when the position sensor receives the optical signal from an emitter (not shown), mounted in this case on the left-hand pinion 41 of the mechanism for moving the carriage 11.

Figure 6:
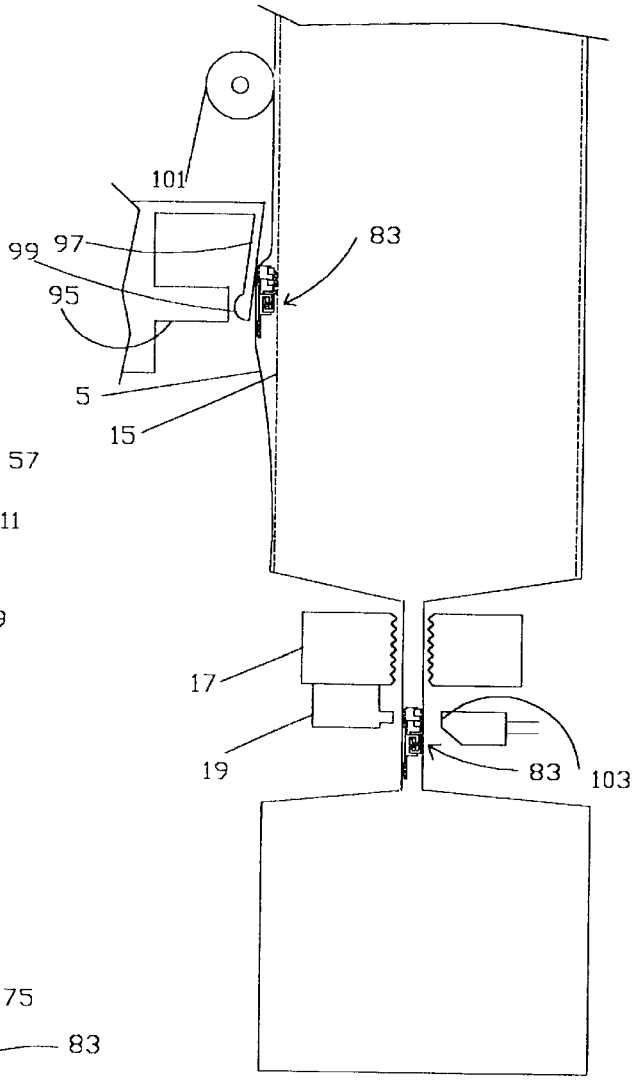
FIG. 6 shows an enlarged side view of the component parts of the device of the present embodiment placed downstream of the carriage.
Figure 7A:
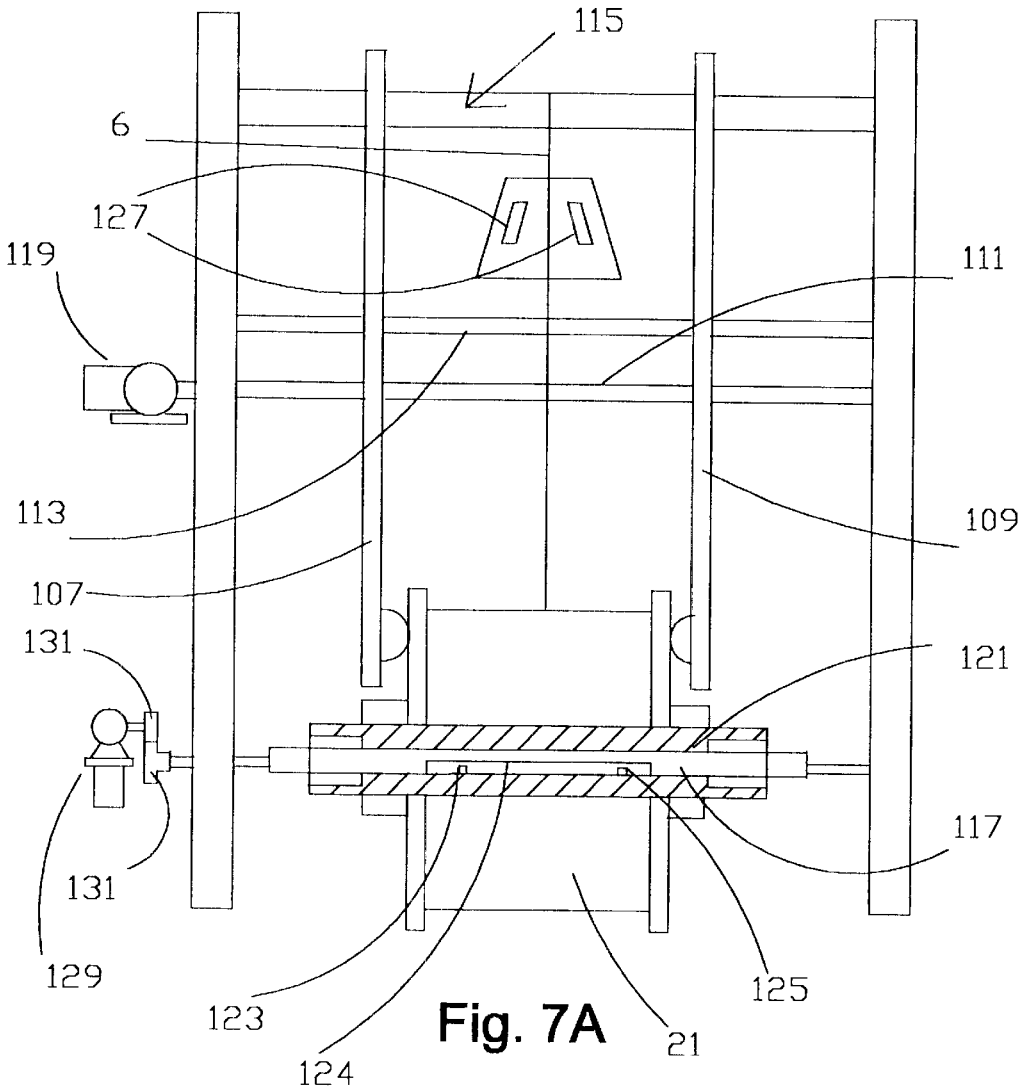
FIG. 7*a* shows a partially sectioned side view of the feeder of the zip with the means for aligning the zip with the guide block of the carriage.
Figure 7B:
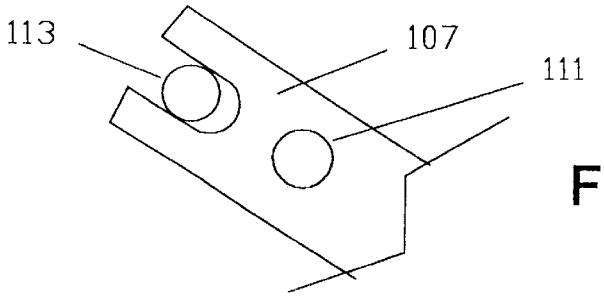
FIG. 7*b* shows an enlarged front view of a detail of the means for alignment of the zip of FIG. 7*a*.

Advantageously, as mentioned previously and as will be made clearer hereinbelow, the speed of the device is improved by presetting the reference position of the carriage 11 behind the position of the first weld of the zip 6. In FIG. 6 the device for application of the zip also allows the position of the zip to be detected downstream of the carriage 11 in order to centre it subsequently on the welding bar of the second welding unit 19. In order to do this a zip detection system is provided comprising a proximity sensor 95 and a harmonic tab 97 supported by the frame of the machine 1 and carrying at the free end a pawl 99 facing the point of the wall of the forming tube 15 at which the zip 6, attached to the wrapping 5, transits. When the zip 6 transits on the pawl 99, the blade 97 is deflected towards the sensor 95, thus originating the signal of position of the zip 6. Upstream of the sensor 95 a metric wheel 101 is finally located which drives feeding of the wrapping 5, starting from the position of the zip 6 detected by the proximity sensor 95, for a section equal to the distance between the point of reading of the proximity sensor 95 and the point of welding of the plate 103 of the second unit 19 for final welding of the zip 6. In FIGS. 7*a* and 7*b* the unit for support, unwinding and centring of the reel of the zip 6 is shown.

The unit includes a fork inserted on the reel 21 and formed by two arms 107 and 109 capable of translating thanks to the rotation of the screw 111 actuated by a motor 119, in that it is restrained in order not to rotate by a rod 113 attached to the frame 115 parallel to the screw 111 and to the shaft 117 of the reel 21. A tube 121 integral with the reel 21 covers the shaft 117 concentrically and supports its axial sliding. On the shaft 117, which is driven by a motor 129 by means of pinions 131, axial milling 124 is formed which acts as a guide and limiter of stroke of the two tabs 123 and 125 attached radially to the tube 121 and designed to transmit rotation between the shaft 1 17 and the tube 121. The point of unwinding of the zip 6 from the reel 21 is initially aligned with a sensor 127: if the point of unwinding of the reel 21 is misaligned from the sensor 127, the latter commands its realignment by translating the reel 21.

The reel 21 can be translated also by replacing the screw 111 with a pair of pistons acting in an opposite direction on arms 107 and 109.

Centring of the reel 21 prevents the zip from twisting and thus facilitates its entrance in the guide block 47 and its subsequent support by the blade 77.

The operation of the device for application of the zip is divided into a phase of start of production and true and proper production.

During the production start phase the carriage 11 moves forwards and backwards, seeking the reference position at which it stops and enables the packaging machine to feed the wrapping.

The photoelectric cell, via the programmable controller, then commands stopping of the feeding.

Figure 5:
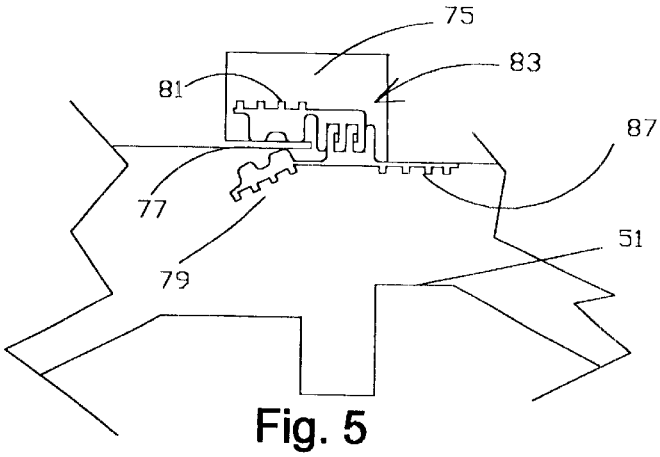
FIG. 5 shows an enlarged view of the zip inserted in the device in the position of the first weld of FIG. 4.

With the wrapping at a standstill the carriage 11 moves to seek the notch on the wrapping, and having found it the plate 51 of the first welding unit 8 performs the first welding of the zip, which consists in welding only the front edge 87 of the male element of the zip enabled by the shape of the welding plate 51 illustrated in FIGS. 4 and 5.

Such a type of weld, which leaves the zip swinging freely around the only welded edge, is particularly advantageous in that it allows the zip to adapt more easily to the new shape which the wrapping adopts on the forming tube. Thus the onset of tensions between wrapping and zip, which may damage the finished packaging, is considerably reduced.

Having ended welding, the plate 51 returns into the rest position, the buffer 89 extracts the zip from the housing 75 of the zip support block 49 and the carriage 11 returns to the reference position. At this point the packaging machine is re-enabled and proceeds with the subsequent feed.

Once the first zip attached to the wrapping has reached the end part of the forming tube, the production start phase ends and the welding cycle changes, enabling the reading of the position of the zip by the proximity sensor 95.

During the actual production phase the carriage 11 moves forwards and backwards, seeking the reference position, and having reached the latter stops and enables the packaging machine to feed the wrapping.

At the end of feeding the zip is detected by the sensor 95 which enables the metric wheel 101 to read the forward movement of the wrapping and commands the stop of the feeding at a programmed distance from the point of enabling in such a way as to position the zip at the plate 103 of the second unit 19 for welding of the zip. The plate 103, after welding of the bag by the welding unit 17, finally welds the rear edges of the male and female elements of the zip. With the film at a standstill the carriage 11 moves to seek the film notch, and having found the latter enables first welding of the zip and then repositions on the reference position and proceeds with the subsequent feed.

In order to increase the speed of the device, the subsequent feed can be started even before seeking of the reference position by the carriage 11 has ended.

Given that a print is always associated with the wrapping, centring of the print on each packaging formed by the wrapping is made possible by adjusting the position of second welding of the zip and the length of the arm 93 of the photoelectric cell 91.

It is clear that the present description of a possible embodiment is valid by way of a non-limiting example of the present invention, and various modifications are possible without thereby departing from the principle of the invention.

What is claimed is:

1. An assembly, comprising:

a vertical packaging machine; and a device, handled by a programmable controller, for an application of a system of opening and closing the packaging or zip formed by two overlapping elements which can be removably engaged, the vertical packaging machine comprising a framework supporting, in succession, a feeder of notched wrapping for the packaging, a forming tube and a welding unit for welding transverse edges of formed wrapping, the device for applying the system of opening and closing comprising a first welding unit upstream o f the forming tube for a first phase of welding of a zip fed transversely to a direction of forward movement of the wrapping and a second welding unit downstream of the forming tube for a final phase of welding of the zip, upstream of the forming tube, a carriage slidingly supported by the framework of the machine in the direction of forward movement of the wrapping to be formed and in turn supporting said first welding unit, a detector attached to the carriage to read a notch on the notched wrapper, means for moving said carriage in relation to the wrapping starting from a selected reference position on the framework of the machine, until reaching a position of reading of the notch by the detector for a first welding of the zip, and means for positioning the zip on the wrapping in the position selected for the first welding of the zip supported by said carriage.

2. An assembly according to claim 1, further comprising a roller for feeding the wrapping between the feeder and the carriage, and a roller for driving the wrapping between the carriage and the forming tube so as to send the wrapping to the forming tube.

3. An assembly according to claim 1, wherein said means for moving the carriage are in the form of a pair of fixed linear guides arranged longitudinally on the framework of the machine and coupled to a corresponding pair of mobile guides formed on the carriage.

4. An assembly according to claim 1, wherein said means for moving the carriage comprise a rod transversely restrained to the carriage, freely rotating on its axis, said rod carrying at each end a pinion coaxial with said rod, meshing with a corresponding rack longitudinally fixed to the framework of the machine, and a gear motor for actuating one of said pinions.

5. An assembly according to claim 1, further comprising means for feeding the zip transversely to the direction of forward movement of the wrapping supported by said carriage.

6. An assembly according to claim 5, wherein said means for feeding the zip on the wrapping comprise in succession, in the direction of feeding of the zip, a coder for measuring the length of the zip to be applied to the wrapping, and a pair of rollers for feeding the measured zip, moved by a dedicated gear motor.

7. An assembly according to claim 1, wherein said means for positioning the zip comprise in succession, in the direction of feeding of the zip, a first guide block for the zip, a part for cutting the required length of zip to be applied to the wrapping and a second zip support block vertically opposite the first welding unit.

8. An assembly according to claim 6, wherein a first fixed linear guide is provided, arranged transversely on said carriage and coupled to a first and a second mobile guide, said first and respectively second mobile guide being supported by said first fixed linear guide and supporting in turn said first and respectively second block, and a second fixed linear guide transversely arranged on said carriage and coupled to a further mobile guide, said further mobile guide being supported by said second fixed linear guide and supporting in turn said first welding unit.

9. An assembly according to claim 8, wherein the support of each block and of the first welding unit by the corresponding mobile guide is provided with a screw which can be actuated by a knob, and wherein said screw restrains every mobile linear guide and the element supported thereby to the corresponding fixed linear guide, it being possible to loosen said restraint by means of the knob in such a way as to adjust the position of each mobile linear guide on the respective fixed linear guide.

10. An assembly according to claim 8, wherein said coder for measuring the length of zip to be applied to the wrapping and said pair of drive rollers are supported, cantilevered, by the mobile guide supporting said first block.

11. An assembly according to claim 7, wherein said cutting part is in the form of a scythe supported rotatingly by the mobile guide supporting said second block in such a way as to cut the zip transversely to its direction of feed.

12. An assembly according to claim 7, wherein the space between the first and the second block is the minimum necessary for inserting the cutting part.

13. An assembly according to claim 7, wherein said first and second blocks provide a seat for housing the zip and a part for supporting and guiding the zip, extending along the entire transverse extent of said first and second blocks.

14. An assembly according to claim 13, wherein said part for supporting and guiding the zip is in the form of a blade projecting horizontally from the edge of the rear wall of said housing, said blade being insertable between the two rear edges of the zip.

15. An assembly according to claim 8, further comprising, in front of the second block, a buffer supported by the mobile guide supporting the second block and which can be actuated vertically on the wrapping to remove the zip from said housing provided in the second block.

16. An assembly according to claim 1, further comprising means fixed to said carriage for adjusting the position no the successive points of the wrapping whereto a corresponding zip is to be applied.

17. An assembly according to claim 16, wherein the wrapping comprises a succession of equidistant notches with a pitch defining the length of each packaging, wherein said means for adjusting the position of the successive points of the wrapping whereto a corresponding zip is to be applied are in the form of a photoelectric cell for reading said notches, attached to the carriage at an adjustable distance from first welding unit, the relative position between carriage and wrapping for the first welding of the zip being determined at the position of reading of the notch by the photoelectric cell.

18. An assembly according to claim 17, wherein means are provided for detecting said reference position of the carriage.

19. An assembly according to claim 18, wherein said means for detecting said reference position of the carriage are in the form of an optical sensor attached to the framework of the machine at the chosen reference position and capable of detecting a light signal from an emitter integral with the carriage.

20. An assembly according to claim 17, wherein said reference position of the carriage is predetermined behind the position of welding of the zip.

21. An assembly according to claim 1, further comprising on the forming tube, means for detecting the position of the zip and for centering the zip in relation to the second welding unit.

22. An assembly according to claim 21, wherein said means for detecting the position of the zip comprise a proximity sensor fixed to the framework of the machine and a harmonic tab fixed to the framework of the machine and carrying at the end a pawl resting on the point of the forming tube for transit of the zip, said pawl being pushed at transit of the zip towards the proximity sensor to originate the signal of position of the zip.

23. An assembly according to claim 21, wherein said means for centering the zip in relation to the second welding unit are in the form of a metric wheel which drives feeding of the wrapping, starting from the position of the zip detected by the proximity sensor, for a section equal to the distance between the point of reading of the proximity sensor and the point of welding of the second unit of final welding of the zip.

24. An assembly according to claim 1, further comprising a feeder of the zip, said feeder comprising a reel of the zip and a framework supporting the reel, and means for centering a point of unwinding of the reel of the zip in relation to said carriage.

25. An assembly according to claim 24, wherein said means for centering the zip comprise, downstream of the reel for feeding the zip, a sensor element aligned with the point of unwinding of the zip from the reel in such a way as to detect misalignment, said sensor enabling means for the axial translation of the reel for feeding the zip to correct misalignment.

26. An assembly according to claim 24, wherein said reel comprises a rotation shaft externally and coaxially covered by a tube for translation of said reel, said translation tube and said shaft comprising reciprocal engaging means so as to rotate integrally and translate axially one in relation to the other.

27. An assembly according to claim 26, wherein said reciprocal engaging means are in the form of a pair of tabs fixed radially on the translation tube and an axial milling of said shaft for guiding said pair of tabs.

28. An assembly according to claim 24, wherein said means for the axial translation of the reel comprise a fork frontally inserted on the zip feed reel, a rod for guiding the fork fixed to the framework of the reel parallel to the reel shaft and slidingly supporting said fork, and a screw supported by the framework of the reel parallel to the shaft of the reel and which can be screwed in at least one threaded hole provided on the fork for the translation of the fork and consequently of the reel inserted therein.

29. An assembly according to claim 24, wherein said means for the axial translation of the reel comprise a fork frontally inserted on the zip feed reel, a guide rod of the fork fixed to the framework of the reel parallel to the shaft of the reel and slidingly supporting said fork, and a pair of pistons which can be actuated each on an arm of the fork for translation of the fork and consequently of the reel inserted therein.

30. A method for the production of a packaging with a device for opening and closing the packaging in the vertical packaging machine provided in claim 1, wherein an initial production phase is provided comprising the following time sequence of operations:

positioning of the carriage in the reference position;

feeding of the wrapping for a predetermined section;

movement of the carriage on the wrapping into the position of reading of the notch by the detector;

first welding of the front edge of an element of the zip by the first unit for welding the zip;

actuation of a buffer to remove the wrapping from a housing of a zip support block;

repositioning of the carriage at the reference position; and subsequent feeding.

31. A method according to claim 30, wherein said operations are repeated cyclically until the first zip attached reaches an end part of the forming tube and thus ends the initial production phase and in that the initial production phase is followed by a true and proper production phase comprising the following time sequence of operations:

positioning of the carriage in the reference position;

feeding of the wrapping until detection of the zip by a proximity sensor;

enabling of the metric wheel to command stopping of feeding at the distance from a point of enabling wherein the zip corresponds to a welding plate of the unit for a final welding of the zip;

welding of remaining edges of the zip by the unit for final welding of the zip;

movement of the carriage on the wrapping in the position of reading of the notch by the detector;

first welding of the front edge of an element of the zip by the first unit for welding of the zip;

actuation of the buffer for removing the wrapping from the housing of the zip support block;

repositioning of the carriage at the reference position; and subsequent feeding.

32. A method according to claim 31, wherein the subsequent feed, instead of taking place after reaching of the reference position by the carriage, begins during seeking of the reference position by the carriage.

33. An assembly of a vertical packaging machine and a device for an application of a system of opening and closing the packaging or zip formed by two overlapping elements which can be removably engaged, the vertical packaging machine comprising a framework supporting in succession a feeder of wrapping for the packaging, said wrapping comprising equidistant notches, a forming tube and a welding unit for welding transverse edges of formed wrapping, and the device for applying the system of opening and closing comprising a first welding unit upstream of the forming tube for a first phase of welding of a zip fed transversely to a direction of forward movement of the wrapping and a second welding unit downstream of the forming tube for a final phase of welding of the zip, wherein said device, handled by a programmable controller, also comprises, upstream of the forming tube, a carriage slidingly supported by the framework of the machine in the direction of forward movement of the wrapping to be formed and in turn supporting said first welding unit, and a photo-electric cell attached to the carriage to read the equidistant notches on the wrapper, means for moving said carriage in relation to the wrapping starting from a selected reference position on the framework of the machine, until reaching a position of reading of the notch by the photoelectric cell for a first welding of the zip, and means for positioning the zip on the wrapping in the position selected for the first welding of the zip supported by said carriage.

* * * * *